US007870841B2

(12) United States Patent
Methley

(10) Patent No.: US 7,870,841 B2
(45) Date of Patent: Jan. 18, 2011

(54) VARIABLE VALVE ACTUATION SYSTEM FOR AN INTERNAL COMBUSTION ENGINE

(75) Inventor: Ian Methley, Witney (GB)

(73) Assignee: Mechadyne PLC, Kirtlington (GB)

( * ) Notice: Subject to any disclaimer, the term of this patent is extended or adjusted under 35 U.S.C. 154(b) by 460 days.

(21) Appl. No.: 12/108,672

(22) Filed: Apr. 24, 2008

(65) Prior Publication Data

US 2008/0223321 A1 Sep. 18, 2008

(51) Int. Cl.
*F01L 1/34* (2006.01)

(52) U.S. Cl. ..... 123/90.16; 123/90.15; 123/90.39

(58) Field of Classification Search ..... 23/90.15, 23/90.16, 90.39

See application file for complete search history.

(56) References Cited

U.S. PATENT DOCUMENTS 6,584,943 B1 * 7/2003 Klotz ..... 123/90.16

FOREIGN PATENT DOCUMENTS

EP 1649148 4/2006

JP 7180515 7/1995

* cited by examiner

*Primary Examiner*—Zelalem Eshete
(74) *Attorney, Agent, or Firm*—Chernoff, Vilhauer, McClung & Stenzel

(57) ABSTRACT

A valve system is disclosed for an internal combustion engine which allows a secondary valve event, serving for example to provide internal EGR, to be selectively disabled. The system comprises two valve 10 and 22, a first cam 20 acting on the first valve 10 by way of a rocker 12 pivotable about a fixed pivot axis and a second cam 36 having at least two lobes and acting on the second valve 22 by way of a second rocker 24 pivotable about an eccentric 26. The second of the two lobes of the second cam 36 is arranged to open the second valve 22 at a time that the first valve 10 is opened by the first cam 20. A selectively operable latching mechanism 50 latches the eccentric 26 in a fixed position in which each of the cam lobes of the second cam causes the second valve to open. When the latching mechanism 50 is released, a coupling between the eccentric 26 and the first rocker 12 causes or permits the eccentric 26 to move during the opening of the first valve 10 in a sense to oppose the lifting of the second valve 22 by the second lobe of the second cam.

9 Claims, 3 Drawing Sheets

VARIABLE VALVE ACTUATION SYSTEM FOR AN INTERNAL COMBUSTION ENGINE

FIELD OF THE INVENTION

The present invention relates to a variable valve actuation system for an internal combustion engine.

BACKGROUND OF THE INVENTION

It is widely known that variable valve actuation can be used to improve fuel economy and emissions by reintroducing hot exhaust gasses into the combustion chamber. This is often referred to as internal exhaust gas recirculation (EGR). It is distinguished from external EGR which is effected by way of a passage that leads from the exhaust to the intake manifold and includes an EGR valve.

One method of generating internal EGR involves the re-opening of the exhaust valve during the induction stroke. As the piston moves down the cylinder, exhaust as well as intake gases are introduced into the cylinder prior to compression and ignition.

EP 1649148 shows an example of a continuously variable lift system, which sums the lift from two separate cam profiles, to reopen the exhaust valve during the induction stroke. This system allows for precise control over the amount of internal EGR generated as the secondary exhaust valve lift is continuously variable.

OBJECT OF THE INVENTION

The present invention seeks to provide a secondary valve event, that is selectable to allow internal EGR to be enabled and disabled as required, without the complexity and cost of a continuously variable valve system.

SUMMARY OF THE INVENTION

According to the present invention, there is provided a valve actuation system for an internal combustion engine as hereinafter set forth in claim 1 of the appended claims.

The invention uses a rocker-type switching system to produce a switchable secondary lift on one of a pair of valves. The secondary opening can selectively occur only when the non-switchable valve is lifted from its seat. In this way, the complexity and the cost of the valve system is significantly reduced compared to a continuously variable valve system.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
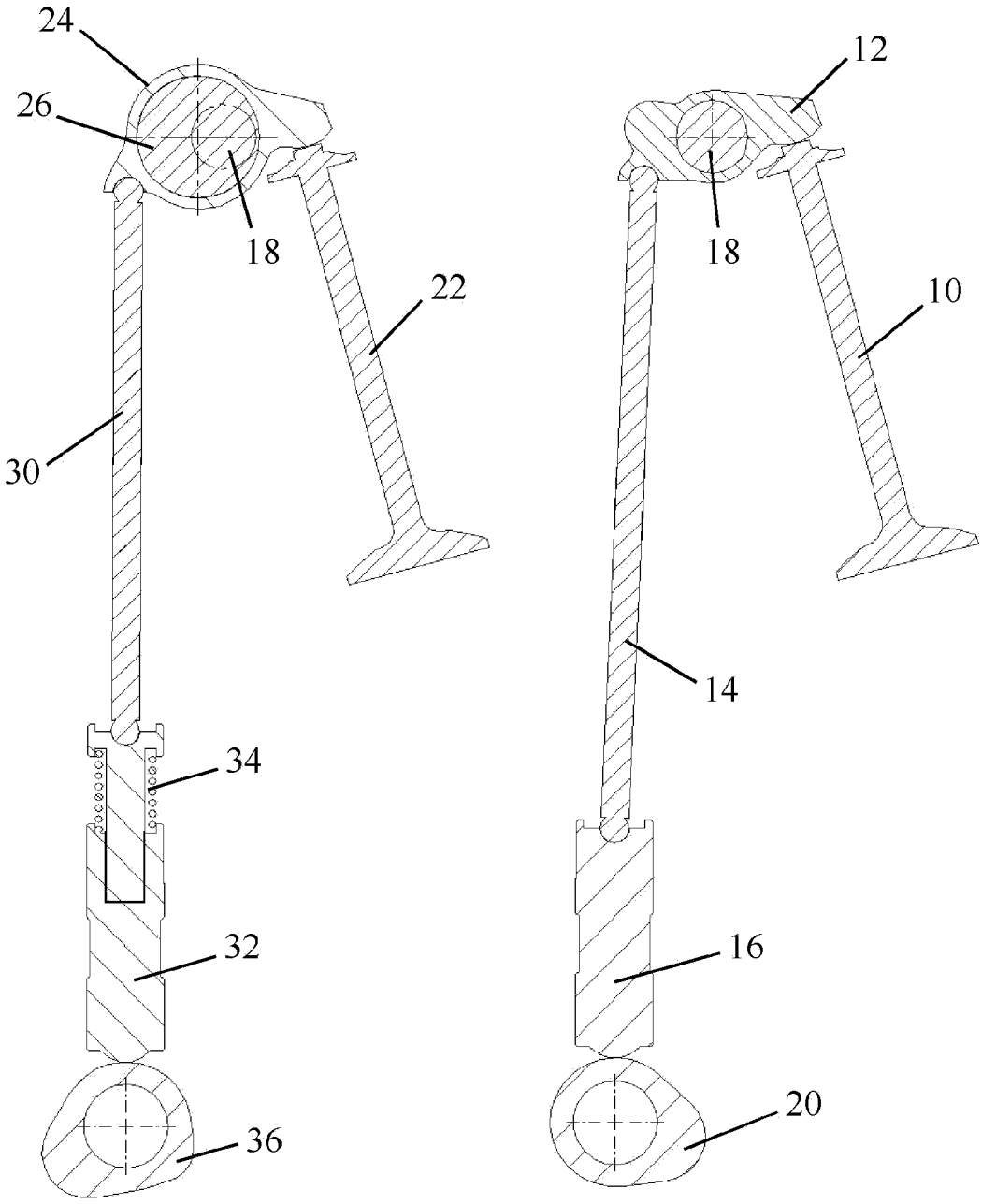
FIG. 1 shows sections through two valves of the same engine cylinder each with its respective operating cam, cam follower, push rod and actuating rocker.
Figure 2:
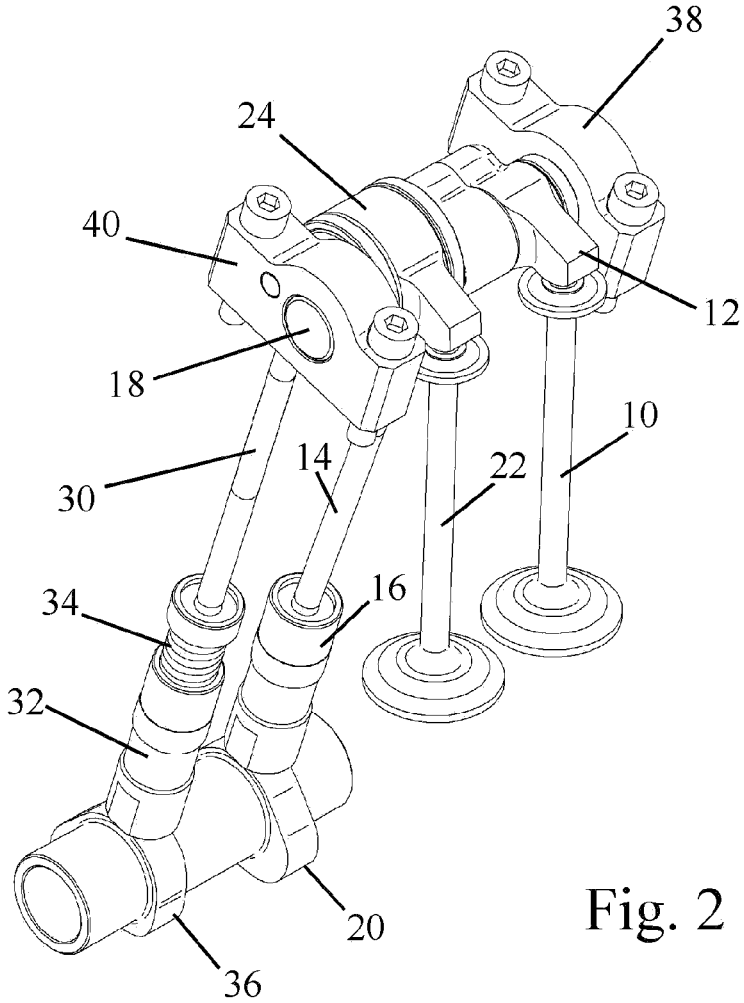
FIG. 2 is a perspective view of an assembled valve system comprising the components shown in FIG. 1.
Figure 3:
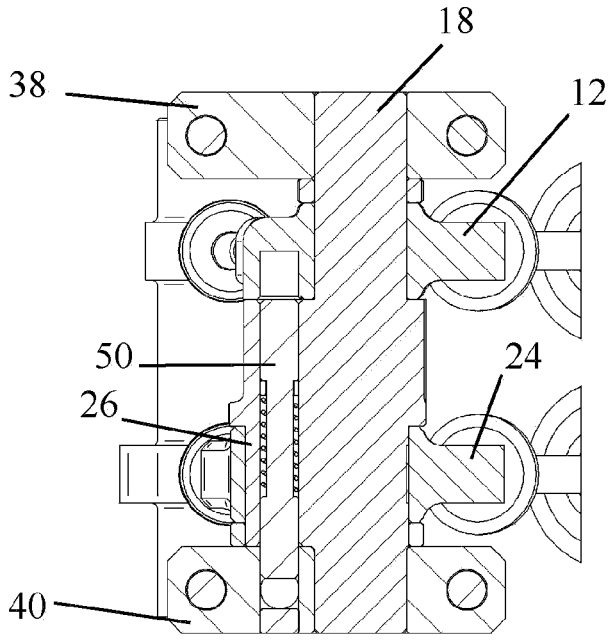
FIG. 3 is a section through the valve system of FIG. 2, the section plane passing through the axis of the rocker shaft.

The valve system shown in FIGS. 1 to 3 comprises two valves 10 and 22 operated by two cams 20 and 36. In the interest of clarity, the first valve 10 will be assumed to be an inlet valve and the second valve 22 an exhaust valve though this need not necessarily always be the case.

The cam 20 for the inlet valve 10 has a single lobe and acts on the valve 10 by way of a cam follower 16, a push rod 14 and a rocker 12 pivotable about a rocker shaft 18. The rocker shaft 18 is mounted in two pillar blocks 38 and 40 in the engine cylinder head so that its axis is fixed.

The exhaust valve 22 is driven by a cam 36 that has two lobes. One of the lobes is designed to open the exhaust valve 22 during the exhaust stroke while the other lobe opens the exhaust valve 22 for a second valve event during the induction stroke. This second valve event readmits exhaust (EGR) gases into the combustion chamber to mix with the intake charge entering through the inlet valve 10.

As will now be described, the drive train of the exhaust valve 22 is designed to allow only the second of the two exhaust valve events to be selectively switched on and off, so as to allow the engine to be operated, as required at any time, either with or without internal EGR.

The cam 36 acts on a telescopic cam follower 32 of which the inner and outer sections are biased apart by a spring 34. A push rod 30 conveys movement of the cam follower 32 to one arm of a rocker 24 of which the other arm acts on the valve 22. The rocker 24 is pivoted about an eccentric 26 which can itself rotate about the axis of the rocker shaft 18.

Except where otherwise stated the above description of the drive trains applies to all the embodiments of the invention shown in the drawings. To avoid unnecessary repetition, the same reference numerals will be retained throughout the description for identical components. Where components are modified but serve the same function, 100 will be added to their reference numerals for the second embodiment and 200 for the third embodiment.

In all three embodiments of the invention to be described, the engine can operate in two modes, namely with and without EGR. In the EGR mode, the eccentric 26 is held stationary by a latching mechanism which locks it to the adjacent pillar block 40 in the fixed position shown in FIG. 1. This results in the exhaust valve 22 opening twice during each engine operating cycle, once during the exhaust stroke and once during the induction stroke.

In the non-EGR mode, the eccentric 26 remains in its fixed position for the whole of the valve lifting event of the first lobe of the cam corresponding to the engine exhaust stroke. However, during the induction stroke, the eccentric 26 is rotated or allowed to rotate clockwise about the axis of the rocker shaft 18, to prevent the exhaust valve 22 from opening. More particularly, at the same time as the push rod 30 moves upwards under the action of the second cam lobe, the eccentric 26 rotates clockwise and raises the pivot axis of the rocker 24. Provided that the movement of the centre of the eccentric is equal to or greater than the maximum lift of the second cam lobe the valve 22 will not be opened.

The three described embodiments of the invention only differ from one another in the manner in which the necessary oscillation of the eccentric 26 in synchronism with the engine operating cycle is achieved. All three illustrated embodiments utilise the motion of the intake rocker to enable the eccentric 26 to rotate when the secondary exhaust lift is to be deactivated.

In the embodiment of FIGS. 1 to 3, a hydraulically operated latch pin 50 is movable axially between two end positions. In the first position (illustrated in FIG. 3) the eccentric 26 is locked to the pillar block 40 to allow the engine to operate with EGR. In the second position, the latch pin 50 engages directly in a hole in the rocker 12 so that the eccentric 26 of the second rocker 24 moves with the first rocker 12. Thus, at the same time as the rocker 12 moves to open the inlet valve 10 it rotates the eccentric 26 clockwise to disable the EGR event in the manner described above.

The lash in the system is likely to vary during the rotation of both the second cam 36 and the eccentric 26 and during this time the spring 34 of the lash adjuster in the cam follower 32 will ensure that the push rod 30 remains in contact with the rocker 24.

The eccentric 26 in the embodiment of FIGS. 1 to 3 is either positively locked to the pillar block 40 or positively driven by the rocker 12. The embodiments of FIGS. 4 to 7 allow the construction of the latch mechanism to be simplified by taking advantage of the fact that, because of the resistance of the valve 22, the unlatched eccentric will itself be rotated clockwise by the upward movement of the push rod 30 and the spring 34 of the lash adjuster in the cam follower 32. There is therefore no need for the eccentric 26 to be positively driven at all times.

Figure 5:
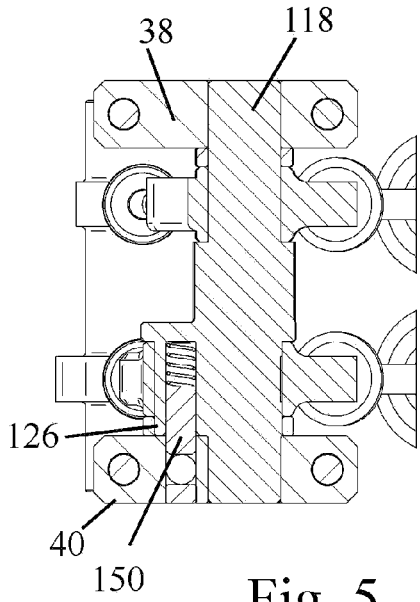
FIG. 5 is section similar to that of FIG. 3 passing through the rocker shaft of the embodiment of the invention shown in FIG. 4.

As shown in FIG. 5, the latch mechanism of the second embodiment of the invention comprises a latch pin 150 that can only lock the eccentric 126 to the pillar block 40. When the pin 150 is retracted, the eccentric can move freely. However, its range of movement is restricted by a ridge 160 projecting axially from the eccentric 126 and cooperating with a stop 162 on the rocker 112 of the inlet valve 10. These two elements form a lost motion coupling.

The eccentric 126 is spring biased away from its latched position by the lash adjuster spring 34. During the first exhaust valve event, the upwards movement of the push rod 30 applies a force to rotate the eccentric 126 clockwise. However, on account of the inlet valve being closed, the contact between the ridge 160 and the stop 162 on the rocker 112 prevents rotation the eccentric 126. In this context, it is important to note that the valve spring of the inlet valve 20 should be made sufficiently stiff to resist the force acting to rotate the eccentric. The eccentric 126 therefore remains stationary and allows the exhaust valve 22 to the opened by the first cam lobe.

When, on the other hand, the second lobe attempts to open the exhaust valve 22, the eccentric 126 will have rotated clockwise because the inlet rocker 112 will have been rotated clockwise to open the inlet valve 10 and the follower 34 will have expanded to keep its stop 162 in contact with the ridge 160. The eccentric 126 is therefore allowed to rotate and instead of opening the exhaust valve 22, the upwards movement of the push rod is then absorbed by the clearance in the cam follower 32. In this way, the EGR valve event is prevented from taking place.

Figure 4:
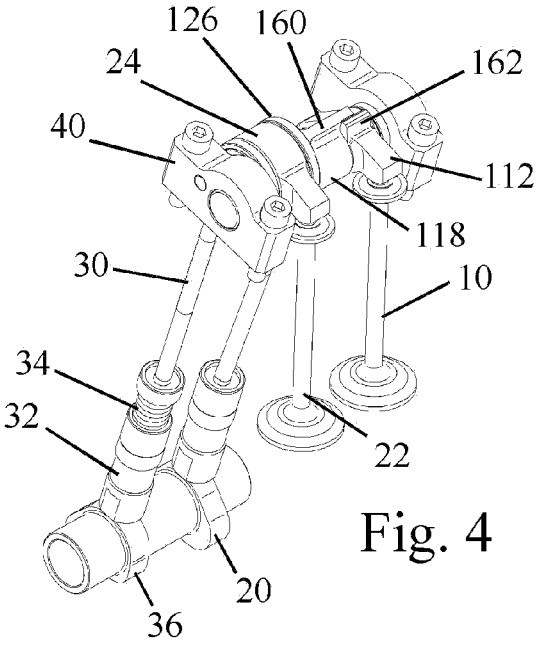
FIG. 4 is a perspective view similar to that of FIG. 2 showing an alternative embodiment of the invention.
Figure 6:
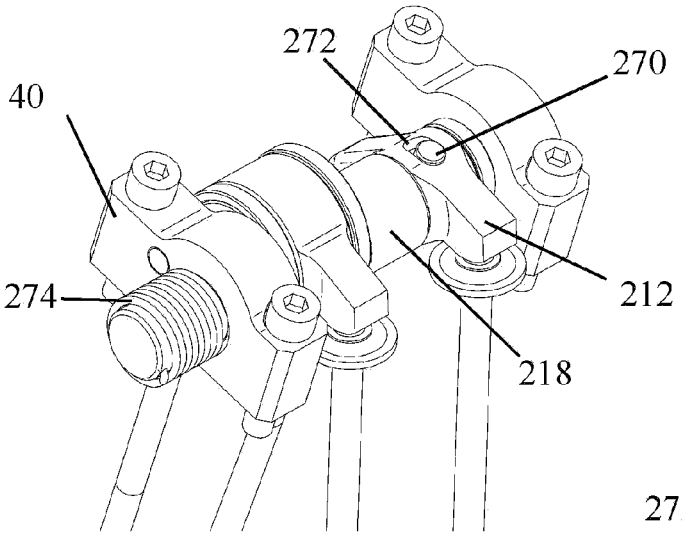
FIG. 6 is a perspective view of a third embodiment of the invention.
Figure 7:
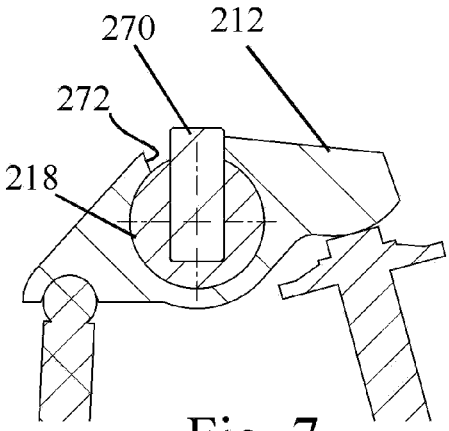
FIG. 7 is a section through the first rocker of the embodiment shown in FIG. 6, the section plane being normal to the pivot axis of the rocker.

The embodiment of FIGS. 6 and 7 is in principle the same as that of FIGS. 4 and 5 save for the manner in which lash in the system is taken up. As the eccentric is integral with the rocker shaft 218, the lost motion coupling connecting the eccentric to the first rocker 212 more simply comprises a pin 270 projecting radially from the rocker shaft 218 into a tangentially elongated hole 272 in the inlet valve rocker 212. The lash adjuster in the cam follower is furthermore omitted and replaced by a torsion spring 274 which acts between the pillar block 240 and the rocker shaft 218 to bias the eccentric towards its latched position. In this case, the spring 274 ensures that the rocker 218 remains in contact with the push rod 30 and the valve 22 at all times and a clearance is allowed between the pin 270 and the end of the elongated hole 272.

As the embodiment of FIGS. 6 and 7 does not require a spring biased lash adjuster in the cam follower, its configuration is equally applicable to overhead cam engines, where the torsion spring 274 can control the extra clearance within the system when the second lift is de-activated.

The invention claimed is:

1. A valve actuation system for an internal combustion engine comprising:

a first gas exchange valve, a first cam acting on the first valve by way of a rocker pivotable about a fixed pivot axis, a second gas exchange valve, a second cam having at least two lobes and acting on the second valve by way of a second rocker pivotable about an eccentric, the second of the two lobes of the second cam being arranged to open the second valve at a time that the first valve is opened by the first cam, a selectively operable latching mechanism for latching the eccentric in a fixed position in which each of the cam lobes of the second cam causes the second valve to open, and means responsive to the position of the first rocker for causing or permitting the eccentric to move during the opening of the first valve in a sense to oppose the lifting of the second valve by the second lobe of the second cam when the latching mechanism is released.

2. A valve actuation system as claimed in claim 1, wherein the latching mechanism has a first position in which the eccentric is prevented from moving and a second position in which the eccentric is directly coupled for movement with the first rocker.

3. A valve actuation system as claimed in claim 2, wherein a spring biased lash adjuster is provided in a cam follower of the second cam, to take up any variations in the clearance between the second cam and the second rocker.

4. A valve actuation system as claimed in claim 1, wherein the latching mechanism has a first position in which the eccentric is prevented from moving and a second position in which the eccentric is free to move and wherein a coupling acting between the eccentric and the first rocker limits movement of the eccentric in the sense opposing the lifting of the second valve in dependence upon the position of the first rocker.

5. A valve actuation system as claimed in claim 4, wherein the coupling comprises a stop on the first rocker.

6. A valve actuation system as claimed in claim 5, wherein the eccentric is urged by the action of a spring away from the fixed position to contact the stop on the first rocker.

7. A valve actuation system as claimed in claim 6, wherein the spring is incorporated into a follower of the second cam and serves to compensate for variations in clearances in the system resulting from movement of the eccentric.

8. A valve system as claimed in claim 4, wherein a torsion spring is provided to bias the eccentric towards the fixed position.

9. A valve system as claimed in claim 1, wherein the latch mechanism is hydraulically operated.

* * * * *